US010369066B2

(12) United States Patent
Spence

(10) Patent No.: US 10,369,066 B2
(45) Date of Patent: Aug. 6, 2019

(54) PERSON LIFTING ASSEMBLY

(71) Applicant: Wanda Spence, Washington, DC (US)

(72) Inventor: Wanda Spence, Washington, DC (US)

( * ) Notice: Subject to any disclaimer, the term of this patent is extended or adjusted under 35 U.S.C. 154(b) by 93 days.

(21) Appl. No.: 15/814,599

(22) Filed: Nov. 16, 2017

(65) Prior Publication Data

US 2019/0142665 A1 May 16, 2019

(51) Int. Cl.

| | |
|---|---|
| ***A61G 5/14*** | (2006.01) |
| ***A61G 5/10*** | (2006.01) |
| ***A61G 5/04*** | (2013.01) |
| ***A47C 7/50*** | (2006.01) |
| ***A61G 5/12*** | (2006.01) |
| ***A47C 3/40*** | (2006.01) |

(52) U.S. Cl.

CPC ..... *A61G 5/14* (2013.01); *A47C 3/40* (2013.01); *A47C 7/506* (2013.01); *A61G 5/04* (2013.01); *A61G 5/1059* (2013.01); *A61G 5/125* (2016.11)

(58) Field of Classification Search

CPC . A61G 5/14; A61G 5/125; A61G 5/04; A61G 5/1059; A47C 3/40; A47C 7/506

USPC ..... 297/344.2, 344.12, 344.18, 411.36, 297/DIG. 10, 423.2

See application file for complete search history.

(56) References Cited

U.S. PATENT DOCUMENTS 1,428,627 A * 9/1922 Grabfelder ..... A47K 13/00 248/436
1,927,598 A * 9/1933 Schlichter ..... B66F 7/14 104/32.1
2,711,787 A * 6/1955 Hallowell, Jr. ..... A47C 3/34 248/188.91
2,869,623 A * 1/1959 Poulin ..... A47C 7/543 297/411.36
3,295,885 A * 1/1967 Barksdale ..... A47C 3/025 297/259.2
3,584,890 A * 6/1971 Presty ..... A61G 5/14 280/304.1
3,619,820 A * 11/1971 Cain et al. ..... A47K 17/026 4/237
3,795,923 A * 3/1974 Thomas ..... A47K 11/04 297/188.08
3,829,908 A * 8/1974 Thomas ..... A47K 11/04 135/75
3,853,372 A * 12/1974 Meyer ..... A61G 5/12 297/45
3,854,773 A * 12/1974 Thomas ..... A47K 11/04 248/188.5
4,052,087 A * 10/1977 Gagliardi ..... A47K 11/04 280/43
4,545,616 A 10/1985 Booth
4,572,577 A * 2/1986 LaRue ..... A61G 5/12 297/423.2

(Continued)

*Primary Examiner* — Syed A Islam

(57) ABSTRACT

A person lifting assembly to assist a person who has fallen get to a standing position includes a plurality of legs that define a first set of legs and a second set of legs. Each of the legs has a telescopically adjustable height. A base is attached to each set of legs such that the base has an adjustable height. A pair of armrests that have an adjustable height is included. Each of the armrests is attached to and extends between one of the sets of legs. A plurality of lifting units where each of the legs has a lifting unit mounted therein that extends into an associated one of the pair of armrests. Each of the lifting units extends or retracts an associated one of the legs with respect to the base to lift or lower the base with respect to the floor surface.

14 Claims, 5 Drawing Sheets

(56) References Cited

U.S. PATENT DOCUMENTS 4,673,155 A * 6/1987 Binder ..... A47C 3/30 108/147
4,715,654 A * 12/1987 Laskowitz ..... A47C 1/0248 248/430
4,770,410 A * 9/1988 Brown ..... A61H 3/04 135/67
4,823,412 A * 4/1989 Spiegel ..... A47K 11/04 4/240
4,962,551 A * 10/1990 Bly ..... A47K 11/04 16/DIG. 13
4,993,085 A * 2/1991 Gibbons ..... A61G 7/1007 4/237
5,027,446 A * 7/1991 Robertson ..... A61G 7/1007 297/DIG. 10
5,123,126 A * 6/1992 Vincent ..... A61H 3/00 4/480
D346,251 S 4/1994 Morooka
5,312,161 A * 5/1994 Mars ..... A47C 7/506 297/423.2
5,335,377 A * 8/1994 Masyada ..... A47K 3/122 297/152
5,427,438 A * 6/1995 Fochs ..... A61H 3/04 135/67
5,536,068 A * 7/1996 Valentor ..... A47C 3/38 297/183.1
5,561,872 A * 10/1996 Phillips ..... A61G 7/1007 4/254
5,588,708 A * 12/1996 Rykken ..... A47C 7/506 297/284.11
5,592,703 A * 1/1997 Jones ..... A61G 7/1007 297/DIG. 10
5,820,152 A * 10/1998 Warren-Pfaeffle ..... A47K 17/026 280/250.1
6,056,353 A * 5/2000 Meara ..... A61G 5/08 297/344.18
6,158,809 A * 12/2000 Gobbers ..... A61G 7/1003 248/405
6,213,554 B1 4/2001 Marcoux et al.
6,871,910 B2 3/2005 Hale
6,957,865 B1 * 10/2005 Adams ..... A47B 91/024 297/344.12
7,021,713 B2 4/2006 Kao et al.
7,032,970 B1 * 4/2006 Kharat ..... A47D 1/103 297/256.11
7,156,465 B2 * 1/2007 Stewart, III ..... A47C 7/021 297/411.36
8,459,741 B2 * 6/2013 Mazzola ..... A47C 3/34 297/16.2
8,720,914 B1 * 5/2014 Heath ..... A61H 3/04 135/67
D800,877 S * 10/2017 Uche ..... D23/299
9,895,281 B1 * 2/2018 Sigsworth ..... A61H 3/00
2004/0051279 A1 3/2004 Grant et al.
2005/0052067 A1 * 3/2005 Grimm ..... A47C 1/03211 297/423.2
2007/0209111 A1 * 9/2007 Boger ..... A61G 7/1007 4/667
2008/0048472 A1 * 2/2008 Kuenzel ..... B63B 29/04 297/184.15
2011/0298249 A1 * 12/2011 Kuno ..... A47C 7/506 297/75
2013/0119738 A1 * 5/2013 Wallis ..... A47C 7/54 297/411.36
2014/0001803 A1 * 1/2014 Chapman ..... B60N 2/265 297/256.11
2015/0075575 A1 * 3/2015 Karlovich ..... A63B 69/0064 135/66
2015/0366729 A1 12/2015 Quick et al.

* cited by examiner

PERSON LIFTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to height adjustable chair devices and more particularly pertains to a new height adjustable chair device to assist a person who has fallen get to a standing position.

BRIEF SUMMARY OF THE INVENTION

An embodiment of the disclosure meets the needs presented above by generally comprising a plurality of legs that define a first set of legs and a second set of legs. Each of the legs has a telescopically adjustable height. A base is attached to the first set of legs and the second set of legs such that the base has an adjustable height relative to a floor surface. A right armrest and a left armrest are included and each has an adjustable height. The right armrest is attached to and extends between the first set of legs. The left armrest is attached to and extends between the second set of legs. A plurality of lifting units is included. Each of the legs has a lifting unit mounted therein and extends into an associated one of the right and left armrests. Each of the lifting units extends or retracts an associated one of the legs with respect to the base to lift or lower the base with respect to the floor surface. A power supply is mounted within one of the armrests and is electrically coupled to the motor. A control switch is mounted in one of the armrest. The control switch is electrically coupled to the motor. The control switch controls a vertical movement of each of the legs and each of the armrests.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
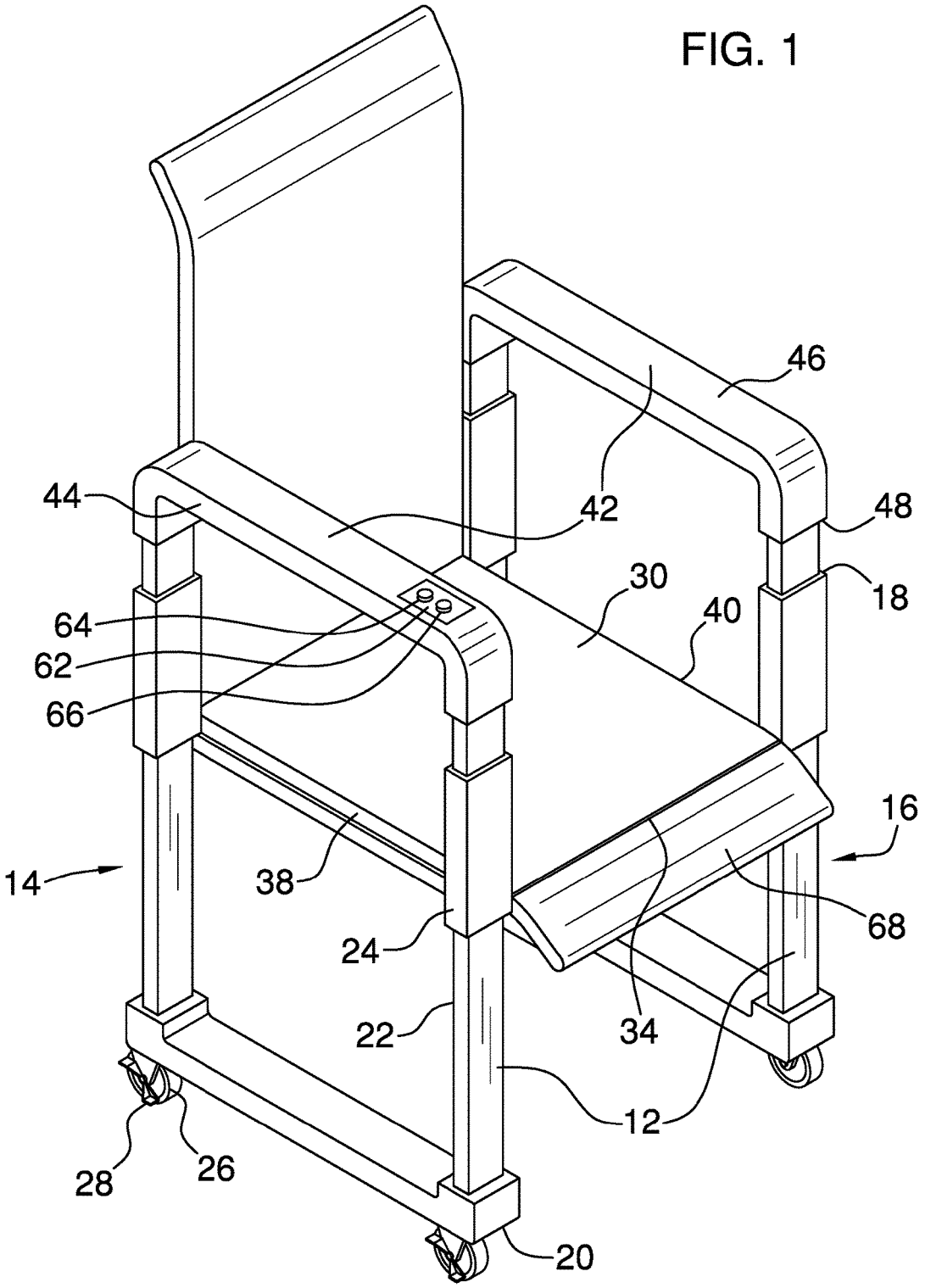
FIG. 1 is a front side view of a person lifting assembly according to an embodiment of the disclosure.
Figure 2:
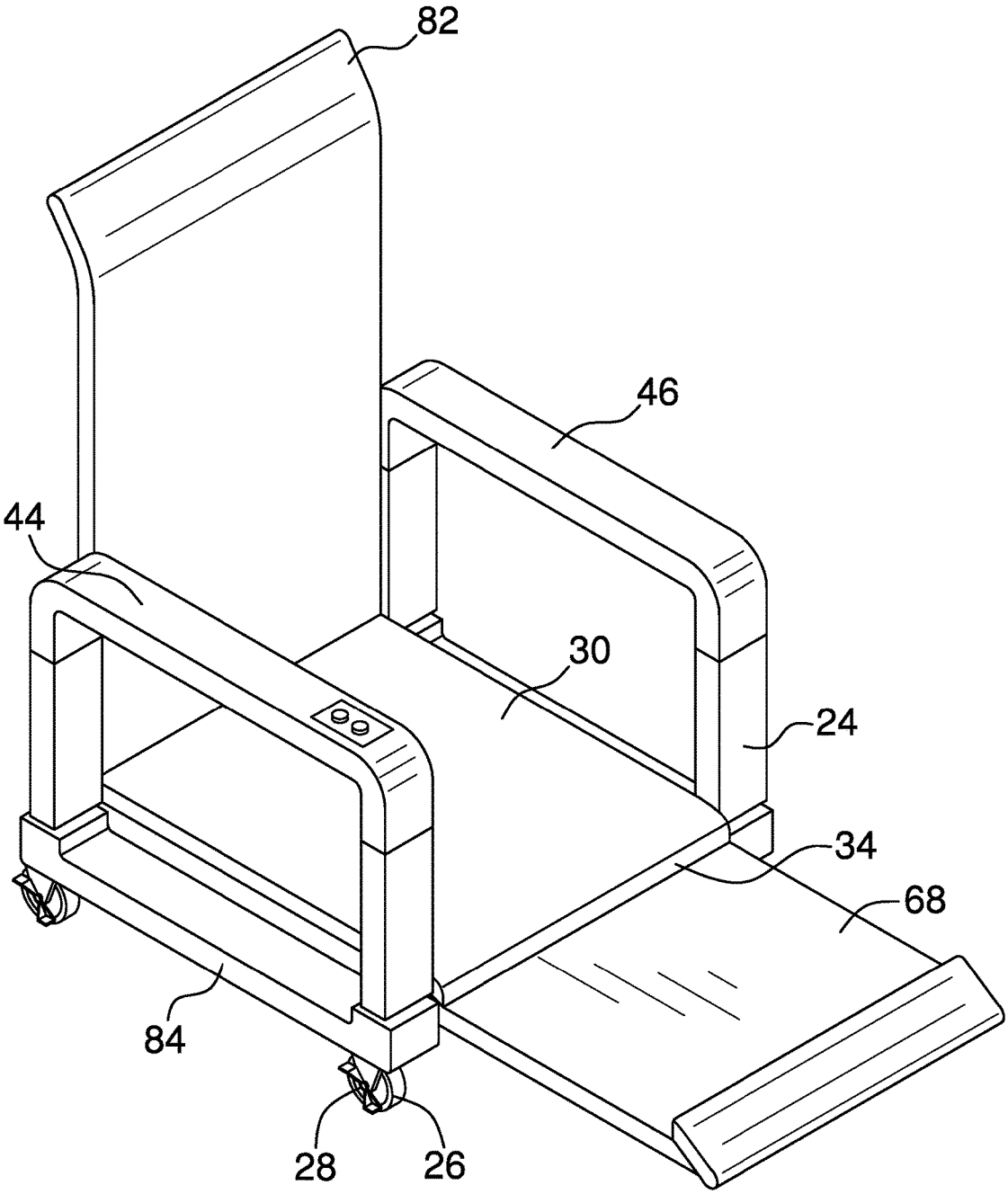
FIG. 2 is a front side view of an embodiment of the disclosure.
Figure 3:
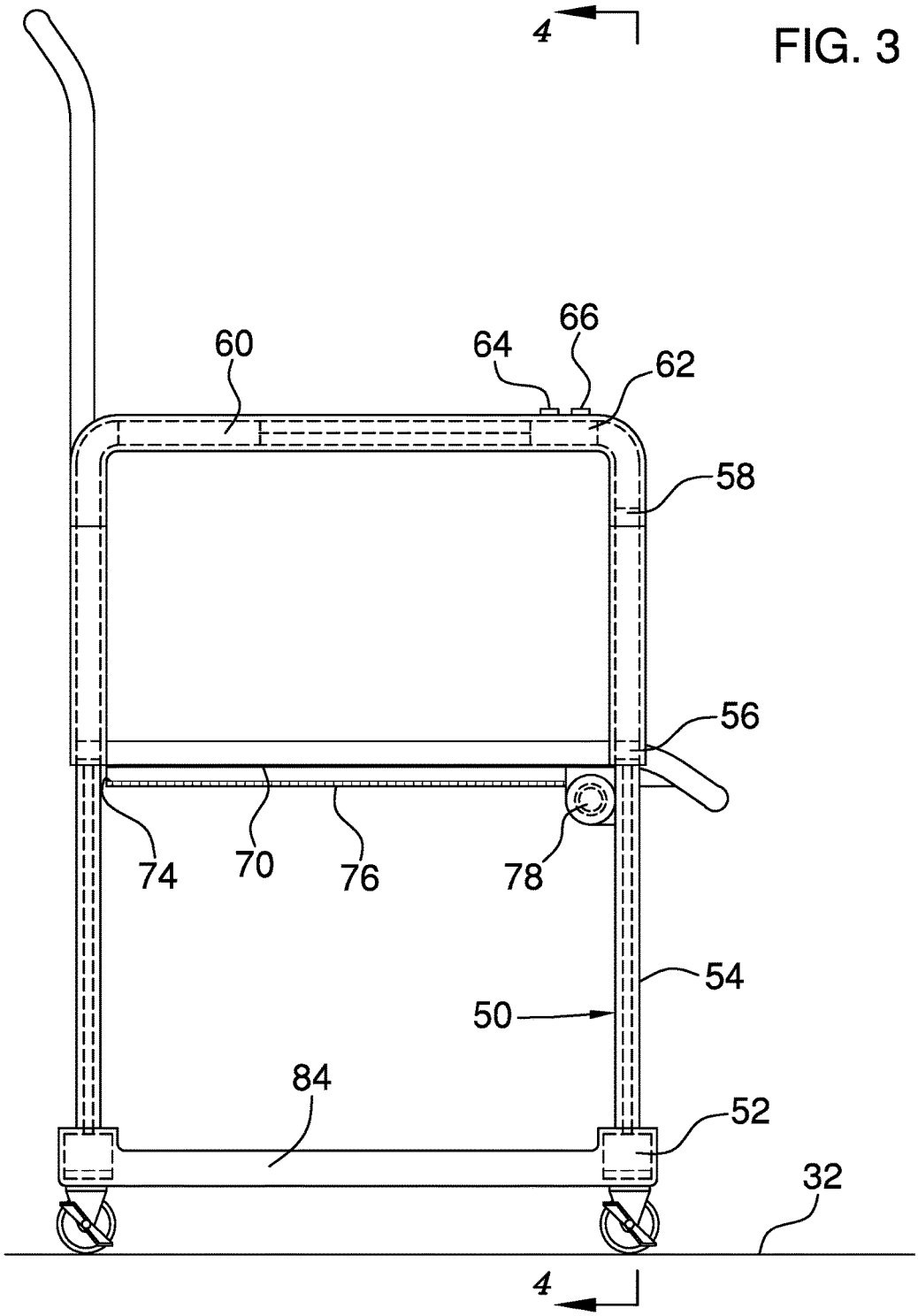
FIG. 3 is a side view of an embodiment of the disclosure.
Figure 4:
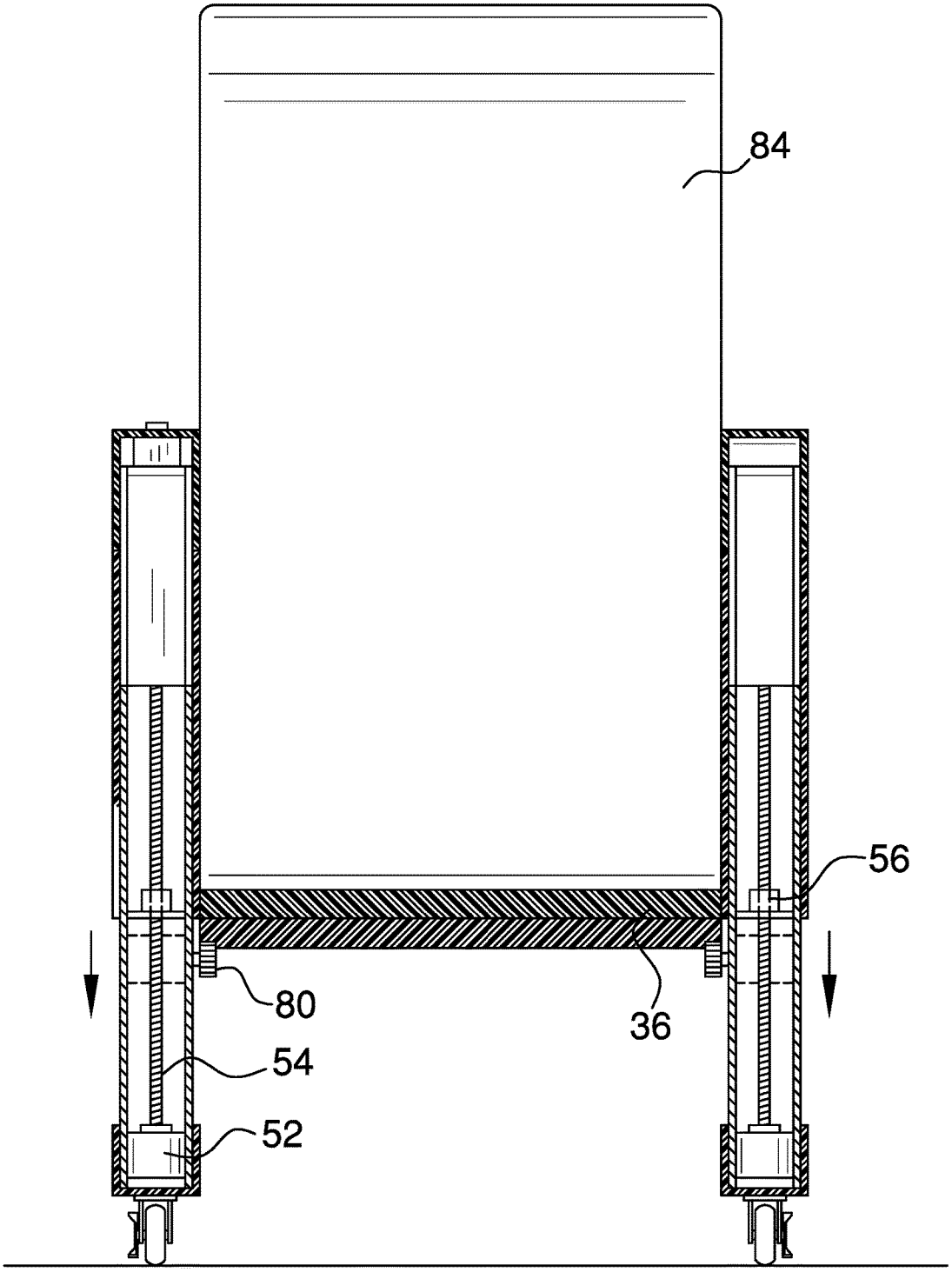
FIG. 4 is a cross-sectional view of an embodiment of the disclosure taken along line 4-4 of FIG. 3.
Figure 5:
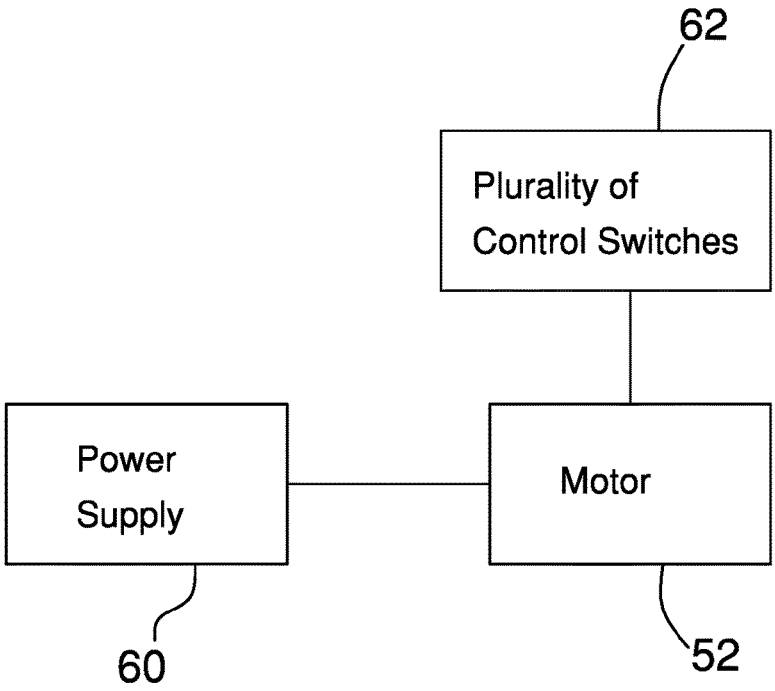
FIG. 5 is a schematic box diagram of an embodiment of the disclosure.

With reference now to the drawings, and in particular to FIGS. 1 through 5 thereof, a new height adjustable chair device embodying the principles and concepts of an embodiment of the disclosure and generally designated by the reference numeral 10 will be described.

As best illustrated in FIGS. 1 through 5, the person lifting assembly 10 generally comprises a plurality of legs 12 that define a first set of legs 14 and a second set of legs 16. Each of the legs 12 has a telescopically adjustable height, a top end 18 and a bottom end 20. Each of the legs 12 also has a lower portion 22 and an upper portion 24 that telescopically receives the lower portion 22. The upper portion 24 is vertically moveable relative to the lower portion 22. A wheel 26 is rotatably attached to the bottom end 20. A lock 28 is positioned on the wheel 26 and releasably retains the wheel 26 in a non-rotational condition.

A base 30 is attached to the first set of legs 14 and the second set of legs 16 such that the base 30 has an adjustable height relative to a floor surface 32. The base 30 has a front side 34, a rear side 36, a first lateral side 38 and a second lateral side 40. The first lateral side 38 has the first set of legs 14 attached thereto and the second lateral side 40 has the second set of legs 16 attached thereto. The base 30 receives a person thereon and lifts the person vertically when each of the legs 12 extends upwardly. The base 30 lies in a horizontal plane and is attached to each of the upper portions 24 such that when the upper portion 24 moves vertically the base 30 moves vertically.

A pair of armrests 42 is included, including a right armrest 44 and a left armrest 46. Each of the armrests 42 has an adjustable height. The right armrest 44 is attached to and extends between the first set of legs 14 and the left armrest 46 is attached to and extends between the second set of legs 16. Each of the armrests 42 has an adjustable height relative to a corresponding one of the first and second sets of legs 14, 16. Each of the armrests 42 has a lower end 48 that engages the top end 18 of a corresponding one of the legs 12 at a fully retracted position.

A plurality of lifting units 50 is included and each of the legs 12 has a lifting unit 50 mounted therein that extends into an associated one of the right and left armrests 44, 46. Each of the lifting units 50 extends or retracts an associated one of the legs 12 with respect to the base 30 to lift or lower the base 30 with respect to the floor surface 32. Each of the lifting units 50 includes a motor 52 that is mounted on the leg 12. A drive rod 54 is threaded and mechanically coupled to the motor 52. The drive rod rotates in a first direction or a second direction when the motor 52 is turned on.

A first drive coupler 56 is threadably mounted to the drive rod 54 such that the upper portion 24 extends upwardly from the lower portion 22 when the drive rod 54 is rotated in a first direction and the upper portion 24 extends downwardly when the drive rod 54 is rotated in a second direction.

A second drive coupler 58 is positioned in the associated one of the right or left armrests 44, 46. The second drive coupler 58 is threadably mounted to the drive rod 54 such that each of the associated one of the right or left armrests 44, 46 extends upwardly when the drive rod 54 is rotated in a first direction and extends downwardly toward the associated leg 12 when the drive rod 54 is rotated in a second direction.

A power supply 60 is mounted within one of the armrests 42 and is electrically coupled to the motor 52. A plurality of control switches 62 is mounted in one of the armrest 42 and is electrically coupled to the motor 52. Each of the control switches 62 controls a vertical movement of each of the legs 12 and each of the armrests 42. The control switches 62 include an up button 64 and a down button 66. The up button 64 actuates each of the lifting units 50 such that the base 30 is lifted upwardly from the floor surface 32 and the down button 66 actuates each of the lifting units 50 such that the base 30 is lowered toward the floor surface 32.

A seat extension 68 is pivotally attached to a bottom side 70 of the base 30. A drive apparatus 72 is mounted to the base 30. The drive apparatus 72 is actuated to alternatingly move the seat extension 68 to a deployed position extending outwardly from the base 30 to a stored position extending downwardly from the base 30. A lower edge 74 of the seat extension 68 may have a plurality of teeth 76 positioned thereon. The drive apparatus 72 may include a drive motor 78. A cog 80 is mechanically coupled to the drive motor 78. The cog 80 engages the teeth 76 and extends the seat extension 68 outwardly when the drive motor 78 is rotated in a first direction and retracts the seat extension 68 when the drive motor 78 is rotated in a second direction. The plurality of control switches 62 may be electrically coupled to said drive motor 78 and may include buttons to extend and retract the seat extension 68.

A backrest 82 is attached to and extends upwardly from the rear side 36. A pair of braces 84 is included wherein a first one of the braces 84 is attached to and extends between the bottom ends 84 of each of the legs 12 in the first set of legs 14. A second one of the braces 84 is attached to and extends between the bottom ends 84 of each of the legs 12 of the second set of legs 16.

In use, the assembly 10 is used to assist a person, which has fallen, to stand back up. When at a fully retracted position, a body of the person is positioned on the base 30 such that the body of the person is orientated in a sitting position. The up button 64 is pressed to actuate each of the lifting units 50 wherein each of the upper portions 24 extend upwardly from a corresponding one of the lower portions 22, thereby moving the base 30 upwardly relative to the floor surface 32 to allow the person to stand up from an elevated sitting position instead of a position adjacent to the floor surface 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motorized chair assembly configured to facilitate lifting a person off of a floor, said assembly comprising:

a plurality of legs defining a first set of legs and a second set of legs, each of said legs having telescopically adjustable height;

a base being attached to said first set of legs and said second set of legs such that said base has an adjustable height relative to a floor surface;

a pair of armrests including a right armrest and a left armrest each having an adjustable height, said right armrest being attached to and extending between said first set of legs, said left armrest being attached to and extending between said second set of legs;

a plurality of lifting units, each of said legs having a lifting unit mounted therein and extending into an associated one of said right and left armrests, each of said lifting units extending or retracting associated ones of said legs with respect to said base to lift or lower said base with respect to said floor surface;

a power supply being mounted within one of said armrests and being electrically coupled to said motor; and a plurality of control switches being mounted in one of said armrest, each of said control switches being electrically coupled to said motor, each of said control switches controlling a vertical movement of each of said legs and each of said armrests.

2. The motorized chair assembly according to claim 1, wherein each of said legs has a top end and a bottom end.

3. The motorized chair assembly according to claim 2, wherein each of said legs has:

a lower portion;

an upper portion telescopically receiving said lower portion, said upper portion being vertically moveable relative to said lower portion;

a wheel being rotatably attached to said bottom end; and a lock being positioned on said wheel, said lock releasably retaining said wheel in a non-rotational condition.

4. The motorized chair assembly according to claim 1, wherein said base has a front side, a rear side, a first lateral side and a second lateral side.

5. The motorized chair assembly according to claim 4, wherein said first lateral side has said first set of legs attached thereto and said second lateral side has said second set of legs attached thereto.

6. The motorized chair assembly according to claim 3, wherein said base is configured to receive a person thereon and lift the person vertically when each of said legs extend upwardly, said base lying in a horizontal plane, said base being attached to each of said upper portions such that when said upper portion moves vertically said base moves vertically.

7. The motorized chair assembly according to claim 2, wherein each of said armrests has an adjustable height relative to a corresponding one of said first and second sets of legs, each of said armrests having a lower end engaging said top end of a corresponding one of said legs at a fully retracted position.

8. The motorized chair assembly according to claim 3, wherein each of said lifting units includes:

a motor being mounted on an associated one of said legs;

a drive rod being mechanically coupled to said motor, said drive rod rotating in a first direction or a second direction when said motor is turned on, said drive rod being threaded;

a first drive coupler being threadably mounted to said drive rod such that said upper portion extends upwardly from said lower portion when said drive rod is rotated in a first direction and said upper portion extends downwardly toward said lower portion when said drive rod is rotated in a second direction; and a second drive coupler being positioned in said associated one of said right or left armrests, said second drive coupler being threadably mounted to said drive rod such that each of said associated one of said right or left armrests extends upwardly when said drive rod is rotated in a first direction and extends downwardly toward an associated one of said legs when said drive rod is rotated in a second direction.

9. The motorized chair assembly according to claim 1, wherein said plurality of control switches includes an up button and a down button, said up button actuating each of said lifting units such that said base is lifted upwardly from said floor surface, said down button actuating each of said lifting units such that said base is lowered toward said floor surface.

10. The motorized chair assembly according to claim 1, further including a seat extension being pivotally attached to a bottom side of said base.

11. The motorized chair assembly according to claim 10, further including a drive apparatus being mounted to said base, said drive apparatus being actuated to alternatingly move said seat extension to a deployed position extending outwardly from said base to a stored position extending downwardly from said base.

12. The motorized chair assembly according to claim 1, further including a backrest being attached to and extending upwardly from said rear side.

13. The motorized chair assembly according to claim 1, further including a pair of braces, a first one of said braces being attached to and extending between said bottom ends of each of said legs in said first set of legs, a second one of said braces being attached to and extending between said bottom ends of each of said legs of said second set of legs.

14. A motorized chair assembly configured to facilitate lifting a person off of a floor, said assembly comprising:

a plurality of legs defining a first set of legs and a second set of legs, each of said legs having telescopically adjustable height, each of said legs having a top end and a bottom end, each of said legs having:

a lower portion;

an upper portion telescopically receiving said lower portion, said upper portion being vertically moveable relative to said lower portion;

a wheel being rotatably attached to said bottom end;

a lock being positioned on said wheel, said lock releasably retaining said wheel in a non-rotational condition;

a base being attached to said first set of legs and said second set of legs such that said base has an adjustable height relative to a floor surface, said base having a front side, a rear side, a first lateral side and a second lateral side, said first lateral side having said first set of legs attached thereto and said second lateral side having said second set of legs attached thereto, said base being configured to receive a person thereon and lift the person vertically when each of said legs extend upwardly, said base lying in a horizontal plane, said base being attached to each of said upper portions such that when said upper portion moves vertically said base moves vertically;

a pair of armrests including a right armrest and a left armrest each having an adjustable height, said right armrest being attached to and extending between said first set of legs, said left armrest being attached to and extending between said second set of legs, each of said armrests having an adjustable height relative to a corresponding one of said first and second sets of legs, each of said armrests having a lower end engaging said top end of a corresponding one of said legs at a fully retracted position;

a plurality of lifting units, each of said legs having a lifting unit mounted therein and extending into an associated one of said right and left armrests, each of said lifting units extending or retracting associated ones of said legs with respect to said base to lift or lower said base with respect to said floor surface, each of said lifting units including:

a motor being mounted on said leg;

a drive rod being mechanically coupled to said motor, said drive rod rotating in a first direction or a second direction when said motor is turned on, said drive rod being threaded, a first drive coupler being threadably mounted to said drive rod such that said upper portion extends upwardly from said lower portion when said drive rod is rotated in a first direction and said upper portion extends downwardly when said drive rod is rotated in a second direction;

a second drive coupler being positioned in said associated one of said right or left armrests, said second drive coupler being threadably mounted to said drive rod such that each of said associated one of said right or left armrests extends upwardly when said drive rod is rotated in a first direction and extends downwardly toward an associated on of said legs when said drive rod is rotated in a second direction;

a power supply being mounted within one of said armrests and being electrically coupled to said motor;

a plurality of control switches being mounted in one of said armrest, each of said control switches being electrically coupled to said motor, each of said control switches controlling a vertical movement of each of said legs and each of said armrests, said plurality of control switches including an up button and a down button, said up button actuating each of said lifting units such that said base is lifted upwardly from said floor surface, said down button actuating each of said lifting units such that said base is lowered toward said floor surface;

a seat extension being pivotally attached to a bottom side of said base;

a drive apparatus being mounted to said base, said drive apparatus being actuated to alternatingly move said seat extension to a deployed position extending outwardly from said base to a stored position extending downwardly from said base;

a backrest being attached to and extending upwardly from said rear side; and a pair of braces, a first one of said braces being attached to and extending between said bottom ends of each of said legs in said first set of legs, a second one of said braces being attached to and extending between said bottom ends of each of said legs of said second set of legs.

* * * * *